United States Patent [19]

Jones et al.

[11] 4,035,253

[45] July 12, 1977

[54] ELECTROLYTIC OXIDATION OF PHENOL AT LEAD-THALLIUM ANODES

[75] Inventors: Glenn C. Jones; Ronald H. Meen, both of Kingsport, Tenn.

[73] Assignee: Eastman Kodak Company, Rochester, N.Y.

[21] Appl. No.: 691,665

[22] Filed: June 1, 1976

[51] Int. Cl.[2] ..... C25B 3/02

[52] U.S. Cl. ..... 204/78

[58] Field of Search ..... 204/78, 293

[56] References Cited

U.S. PATENT DOCUMENTS 3,663,381 5/1972 Covitz et al. ..... 204/78

*Primary Examiner*—R. L. Andrews

*Attorney, Agent, or Firm*—J. Frederick Thomsen; Daniel B. Reece, III

[57] ABSTRACT

The process of electrochemically oxidizing phenol to hydroquinone is improved by employing a corrosion resistant lead-thallium alloy anode while maintaining the concentration of p-benzoquinone in the aqueous reaction medium at a low level.

1 Claim, No Drawings

ELECTROLYTIC OXIDATION OF PHENOL AT LEAD-THALLIUM ANODES

This invention relates to a process for preparing hydroquinone by the electrochemical oxidation of phenol. More specifically, this invention relates to the electrochemical oxidation of phenol to hydroquinone using a lead-thallium alloy anode.

The electrochemical oxidation of phenol to p-benzoquinone, hydroquinone, o-benzoquinone, catechol and a complex mixture of by-products at lead anodes has been known for many years. The electrochemical oxidation of phenol at a lead dioxide on lead anode has been further described recently in U.S. Pat. Nos. 3,509,031; 3,616,323 and 3,663,381. The first mentioned patent suggests the use of lead alloy anodes. Lead-thallium anodes have been disclosed in British Pat. No. 1,260,962 as useful in electrolytic processes in which an aqueous sulfate solution containing certain impurities is employed. That British patent teaches that in such processes a lead-thallium anode is more resistant to corrosion as compared to a conventional lead anode and that the corrosion products are powdery in nature. Powdery corrosion products are readily carried away in the process stream and do not obstruct flow or cause shorting of undivided cells as do corrosion products of other types of anodes.

When a lead-thallium alloy anode was used in the electrochemical oxidation of phenol to hydroquinone and co-product p-benzoquinone according to known techniques, for example those described in U.S. Pat. No. 3,509,031, it was found that the results obtained were substantially inferior to those obtained using a lead anode under the same conditions. More particularly, we found that the current efficiency and chemical yield obtained using a lead-thallium alloy anode were so inferior that economical considerations precluded its use, i.e. the disadvantages of a lead thallium anode far outweighed its advantage of corrosion resistance.

We have discovered that the above-mentioned disadvantages in the use of a lead-thallium alloy anode in the electrochemical oxidation of phenol to hydroquinone can be overcome if during the oxidation the concentration of p-benzoquinone is maintained at a low level. Thus, our invention is an improvement in the electrochemical oxidation of phenol to hydroquinone according to known procedures wherein the improvement comprises using a lead-thallium anode while maintaining a low p-benzoquinone concentration in the solution being electrolyzed. This invention accordingly provides a means for using a corrosion resistant lead-thallium alloy anode without affecting detrimentally current efficiency and chemical yield.

The anodes useful in our improved process are described in the above-cited British patent as consisting of a major proportion of lead and from about 0.5 to 2 percent thallium and can be prepared according to conventional techniques such as those described in that patent. When used to oxidize phenol to hydroquinone in the presence of an electrolyte containing sulfate ion, a coating of lead dioxide and possibly an oxide of thallium is formed on the surface of a lead-thallium alloy anode. The oxidation of phenol therefore occurs at the oxide, primarily lead dioxide, surface of the anode. In describing the anodes employed in our improved process as lead-thallium alloy anodes it is intended to include oxide-coated derivatives thereof.

The choice of cathode material and design is, in general, not critical provided that in the particular anode-cathode system used, the cathode is capable of maintaining the p-benzoquinone concentration in the electrolysis solution at less than 0.05 weight percent, preferably at 0.02 weight percent or less. Examples of suitable cathode materials include lead, nickel and stainless steel.

The above-mentioned concentration of p-benzoquinone can be achieved by increasing the mass transport conditions to the anode and/or increasing the cathode surface area relative to the anode. Excellent mass transport can be achieved by pumping the electrolyte through an undivided plate and frame cell at 2–8 ft./sec. with 5–10 mm. electrode spacing. Use of turbulent flow is preferred. A cell designed with expanded surface electrodes for p-benzoquinone reduction has been discussed by M. Fremery et al., Chem. Ing. Tech. 46 (15) 635 (1974), and in U.S. Pat. No. 3,884,776.

The conditions and materials, including the concentrations of the latter, that are employed in the electrochemical oxidation of phenol to hydroquinone in a sulfate ion-containing aqueous medium are well known. See, for example U.S. Pat. 3,509,031, which is incorporated herein by reference.

The improved process of this invention is further illustrated by the following examples.

EXAMPLE 1

An anode of lead is assembled with a lead cathode, each having an effective area of one square decimeter ($dm^2$), to form a parallel plate flow cell with a spacing of 1.27 cm. The electrolytic cell is mounted in a circulation loop containing a header tank, heat exchanger, gas/liquid separator and a peristaltic pump. The unit is purged with nitrogen and is charged with two gal. (17 lb.) of an aqueous solution containing three weight percent phenol and three weight percent sulfuric acid. A flow rate in the loop of about 130 ml./min. is maintained by gravity. The cell effluent temperature is maintained at 50° C. by chilling the feed while the electrolysis is carried out at 40 $A/dm^2$. Eight runs, each of 8 hours of duration, are carried out. The results, expressed as an average of the eight runs, are shown in Table 1.

In the Table the temperatures given indicate initial and final temperatures, the values for phenol indicate varying concentrations by weight, and the values for hydroquinone (HQ) and p-benzoquinone (BQ) indicate final concentrations by weight. Current efficiency (CE) in percent is calculated as:

$$CE = (100nF/It)\ (\text{moles } HQ + \text{moles } BQ)$$

wherein $N$ = number of electrons transferred at the anode = 4 equivalents/mole; F = Faradays constant = 96,500 coulombs/equivalent; $I$ = average current in amps; and $t$ = time in seconds. The yield is moles of hydroquinone and p-benzoquinone produced per mole of phenol consumed.

EXAMPLE 2

Example 1 is repeated except that a lead-thallium alloy anode containing 2% thallium is used. The results obtained, each an average of four runs that were carried out, are set forth in Table 1.

EXAMPLE 3

A modified one-liter resin flask is equipped with a vibrating mixer (VibroMixer), chilled water cold finger, thermometer and two electrodes. The cathode is a nickel screen (Electromesh 120 count, nickel on copper screen) whose dimensions were approximately 13.5 × 13 $cm^2$ shaped in a half-cylinder shape and placed upright in the flask. The anode is a plate of lead-thallium alloy containing 2% thallium having an effective area (front, back and sides) of 0.25 $dm^2$. The anode is preanodized at 100–200 milliamps for 30 to 45 minutes in three weight percent sulfuric acid. The cell is drained and immediately charged with an aqueous solution of three weight percent phenol and three weight percent sulfuric acid. The solution was electrolyzed at 40 A/$dm^2$ for 4.5 hours during which 7.3 g. phenol is added every 90 minutes to maintain the phenol concentration within a narrow range. The results, an average of two runs, are shown in Table 1. The duration of electrolysis was determined by the total concentration of hydroquinone and p-benzoquinone produced which would be substantially the same as was obtained in Example 1.

EXAMPLE 4

Example 3 was repeated except a lead anode was used and 6.3 g. phenol was added every two hours during electrolysis. The results, each an average of three runs, is shown in Table 1. Less phenol was added in these runs since, as was discovered from Example 3, a narrower range of phenol concentration could be maintained if lesser amounts of phenol were added.

TABLE 1

| Example No. | Temperature ° C. | Phenol, % | HQ, % | BQ, % | CE, % | Yield, % |
|---|---|---|---|---|---|---|
| 1 | 25–50 | 3.0–1.35 | 0.83 | 0.43 | 28.7 | 65 |
| 2 | 25–50 | 3.0–1.72 | 0.61 | 0.20 | 18.4 | 53 |
| 3 | 34–39 | 2.5–3.5 | 1.36 | <0.05 | 28.1 | 66 |
| 4 | 33–40 | 2.5–3.0 | 1.39 | <0.05 | 28.8 | 66 |

The invention has been described in detail with particular reference to certain preferred embodiments thereof, but it will be understood that variations and modifications can be effected within the spirit and scope of the invention.

We claim:

1. In the electrochemical oxidation of phenol to hydroquinone in a sulfate-ion containing aqueous medium in an undivided cell, the improvement comprising the use of an anode of an alloy of a major proportion of lead and about 0.5 to 2 weight percent of thallium while maintaining the concentration of p-benzoquinone in the aqueous medium below about 0.05 weight percent.

* * * * *